US006275136B1

(12) United States Patent
Yamaguchi

(10) Patent No.: US 6,275,136 B1
(45) Date of Patent: Aug. 14, 2001

(54) CIRCUIT BREAKER

(75) Inventor: Noboru Yamaguchi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/438,958

(22) Filed: Nov. 12, 1999

(30) Foreign Application Priority Data

Nov. 16, 1998 (JP) ..... 10-325605

(51) Int. Cl.[7] ..... H01H 37/76; H01H 85/055

(52) U.S. Cl. ..... 337/401; 337/405; 337/182; 337/185; 361/115

(58) Field of Search ..... 337/157, 182, 337/401, 404, 405, 406, 408, 409, 185; 307/9.1–10.8, 119; 180/271, 274, 279, 281–283; 200/61.08; 361/115; 280/227

(56) References Cited

U.S. PATENT DOCUMENTS 3,873,786 * 3/1975 Lagofun ..... 200/61.08
3,885,223 * 5/1975 Green ..... 337/406
4,124,835 * 11/1978 Cahill, Jr. ..... 337/1
4,189,698 * 2/1980 Hara ..... 337/407
4,311,890 * 1/1982 Schroder ..... 200/61.08
4,417,519 * 11/1983 Lutz ..... 102/263
4,803,319 * 2/1989 Bernard et al. ..... 200/147 A
4,821,010 * 4/1989 Plasko ..... 337/405
5,281,776 * 1/1994 Morel et al. ..... 200/144 R
5,310,971 * 5/1994 Vial et al. ..... 200/244
5,360,999 * 11/1994 Upshaw et al. ..... 307/112
5,535,842 * 7/1996 Richter et al. ..... 180/279
5,877,563 * 3/1999 Krappel et al. ..... 307/10.1

FOREIGN PATENT DOCUMENTS 10-55742 * 2/1998 (JP) ..... H01H/39/00
10-241523 * 9/1998 (JP) ..... H01H/39/00
10-241524 * 9/1998 (JP) ..... H01H/39/00

* cited by examiner

*Primary Examiner*—Leo P. Picard
*Assistant Examiner*—Anatoly Vortman
(74) *Attorney, Agent, or Firm*—Finnegan, Henderson, Farabow, Garrett & Dunner, L.L.P.

(57) ABSTRACT

The circuit breaker disclosed in the invention comprises a first connection terminal, a second connection terminal, a rotatable conducting part disposed between the first connection terminal and second connection terminal, a heat generating part, an igniting part igniting depending on a cut-off signal, an elastic member capable of producing a rotating force, and a holding part for holding the conducting part while resisting the rotating force of the elastic member. Herein, when the holding part releases holding of the conducting part as the igniting part ignites depending on the cut-off signal and the heat generating part generates heat, the conducing part is rotated by the rotating force of the elastic member, and the conductive state between the first connection terminal and second connection terminal is cut off.

12 Claims, 5 Drawing Sheets

CIRCUIT BREAKER

BACKGROUND OF THE INVENTION

The present invention relates to a circuit breaker, and more particularly to a circuit breaker for cutting off an electric circuit in a short time.

In an electric equipment system installed in a vehicle, if any abnormality should occur due to load of power window or the like, or if any abnormality should occur in the wire harness or the like composed of plural wires connecting the battery and each load, a large-current fuse interposed between the battery and the wire harness is melted to cut off between the battery and the wire harness, thereby preventing the loads and wire harness from burning down.

In the electric equipment system using such large-current fuse, however, if any abnormality should occur in the load such as power window, or if abnormality should occur in the wire harness of the like connecting the battery and each load, it is set so as not to melt down unless a current large than the preset allowable value flows in the large-current fuse.

Recently, various protective devices have been developed for cutting off between the battery and wire harness by detecting when a large current close to the allowable value is flowing continuously.

SUMMARY OF THE INVENTION

According to the investigation by the present inventor, a protective device as shown in FIG. 8 is considered.

FIG. 8 is a sectional view showing an example of protective device using a bimetal.

Such protective device comprises a housing 103 made of an insulating resin or the like, and forming a fuse compartment 102 at the upper side, a lid 113 for opening and closing the fuse compartment 102 of the housing 103, a power source terminal 105 disposed at the lower side of the housing 103 so that its upper end portion projects into the fuse compartment 102, and the lower end exposed outside, with the portion exposed outside connected to a positive terminal of a battery 104, and a load terminal 109 disposed at the lower side of the housing so that its upper end portion projects into the fuse compartment 102, and the lower end exposed outside, with the portion exposed outside connected to a load 108 through a wire 107 for composing a wire harness 106.

Such protective device further comprises a fusible element 110 made of a low melting point metal disposed in the fuse compartment 102, with one end connected to the upper end of the power source terminal 105, and other end connected to the upper end of the load terminal 109, an intermediate terminal 111 disposed at an intermediate position of the power source terminal 105 and load terminal 109, with the lower end disposed at the lower side of the housing 103 so as to be exposed outside, and the portion exposed outside connected to a negative terminal of the battery 104, and a bimetal 112 made of two long plate members of different metals glued together, with the lower end side connected to the upper end of the intermediate terminal 111 and the upper end side being bent in an L-shaped and disposed oppositely to the fusible element 110.

In such constitution, by manipulation of an ignition switch or the like of the vehicle, while a current is flowing in a route of positive terminal of battery 104, power source terminal 105, fusible element 110, load terminal 109, wire 107 of wire harness 106, load 108, and negative terminal of battery 104, if any abnormality should occur in the load 108 or the wire harness 106 connecting the load 108 and the protective device 101, and a current exceeding the allowable value should flow in the fusible element 110, it is heated and melted down.

As a result, the circuit is cut off, and the load 108 and wire harness 106 are protected.

Or when a large current flows in the fusible element 110 due to some abnormality occurring in the load 108 or the wire harness 106 connecting the load 108 and protective device 101, if it does not exceed the allowable value, the fusible element 110 is heated by the current flowing in the fusible element 110, and the bimetal 112 begins to deform. In a specified time after a large current begins to flow in the fusible element 110, the leading end of the bimetal 112 contacts with the fusible element 110, and a large short-circuit current flows in the fusible element 110 in a route composed of positive terminal of battery 104, power source terminal 105, fusible element 110, intermediate terminal 111 and negative terminal of battery 104, so that it is melted down.

As a result, if lower than the allowable value, when a certain current flows longer than a preset time, the circuit is cut off, and the wire harness 106 and load 108 are protected.

Aside from such protective device 101, a protective device 121 shown in FIG. 9 is also devised by the present inventor.

The protective device 121 shown in FIG. 9 comprises a housing 122 made of insulating resin or the like, a power source terminal 124 buried at one side of the housing 122, with the lower end portion connected to a positive terminal of a battery 123, and a load terminal 128 buried at other side of the housing 122, with the lower end portion connected to a load 127 through a wire 126 composing a wire harness 125.

Moreover, one end of a wire 131 composed of a fusible conductor 129 made of a low melting point metal or the like formed in a U-shape and a heat resistant covering 130 formed to cover the fusible conductor 129 is connected to the upper end of the power source terminal 124, and other end is connected to the upper end of the load terminal 128. This wire 131 has a coil 132 made of a shape memory alloy, showing a shape being wound around the wire 131 as shown in FIG. 9 when it is in martensite phase, and returning to the mother phase in a shape of tightening the wire 131 when heated to temperature of 120° C. to 170° C.

Further, outside of the housing 122, there is an external terminal 133 with the upper end connected to one end of the coil 132 and lower end connected to a negative terminal of the battery 123.

In such constitution, by manipulation of an ignition switch or the like of the vehicle, while a current is flowing in a route of positive terminal of battery 123, power source terminal 124, fusible element 129 of wire 131, load terminal 128, wire 126 of wire harness 124, load 127, and negative terminal of battery 123, if any abnormality should occur in the load 127 or the wire harness 125 connecting the load 127 and the protective device 121, and a current exceeding the allowable value should flow in the fusible element 129, it is heated and melted down.

As a result, the circuit is cut off, and the load 127 and wire harness 125 are protected.

Or when a large current flows in the fusible conductor 129 due to some abnormality occurring in the load 127 or the wire harness 125 connecting the load 127 and protective device 121, if it does not exceed the allowable value, the fusible conductor 129 is heated by the current flowing in the fusible conductor 129, and the temperature of the coil 132 climbs up. In a specified time after a large current begins to flow in the fusible conductor 129, when the temperature of the coil 132 reaches 120° C. to 170° C., the coil 132 is shifted from the martensite phase to the mother phase, and bites into the heat resistant covering 130 softened by heat, an contacts with the fusible conductor 129, and a large short-circuit current flows in the fusible conductor 129 in a route composed of positive terminal of battery 123, power source terminal 124, fusible conductor 129, coil 132, external terminal 133 and negative terminal of battery 123, so that it is melted down.

As a result, if lower than the allowable value, when a certain current flows longer than a preset time, the circuit is cut off, and the wire harness 125 and load 127 are protected.

In these protective devices 101 and 121, however, the following problems have been disclosed.

First, in the protective device shown in FIG. 8, since flow of large current in the fusible element 110 is detected by using the bimetal 112 gluing two kinds of metals differing in the coefficient of thermal expansion, if the magnitude of the current flowing in the fusible element 110 changes, the bimetal 112 is deformed, and the time until cutting off the circuit varies.

Accordingly, in the event of such an abnormality that a large current flows intermittently, the temperature of the fusible element 101 does not rise higher than a certain point, and the protective device 101 may not cut off the circuit appropriately.

On the other hand, in the protective device 121 shown in FIG. 9, since flow of large current in the fusible conductor 129 is detected by using the coil 132 made of shape memory alloy, if the magnitude of the current flowing in the fusible conductor 129 changes, the coil 132 is deformed, and the time until cutting off the circuit varies.

Accordingly, in the event of such an abnormality that a large current flows intermittently, the temperature of the fusible conductor 129 does not rise higher than a certain point, and the protective device 121 may not cut off the circuit appropriately.

Besides, in the protective devices shown in FIG. 8 and FIG. 9, it may be also supposed that the heat reaction time of the thermal deformation conductive members such as bimetal 112 and coil 132 may vary depending on the flowing current. Or, the heat reaction of the thermal deformation conductive members may fail to take place timely in case of abnormality of passing of overcurrent.

The invention is devised on the basis of such investigations, and it is hence an object thereof to present a circuit breaker capable of protecting electric parts by cutting off the circuit in a short time and securely in case an abnormal signal is fed into the vehicle.

The circuit breaker of the invention comprises a first connection terminal, a second connection terminal, a rotatable conducting part disposed between the first connection terminal and second connection terminal, a heat generating part, an igniting part igniting depending on a cut-off signal, an elastic member capable of producing a rotating force and free to expand and contract, and a holding part for holding the conducting part while resisting the rotating force of the elastic member. Herein, when the holding part is holding the conducting part, the conductive state between the first connection terminal and second connection terminal is maintained, and when the holding part releases holding of the conducting part as the igniting part ignites depending on the cut-off signal and the heat generating part generates heat, the conducing part is rotated by the rotating force of the elastic member, and the conductive state between the first connection terminal and second connection terminal is cut off.

In this constitution, when the igniting part ignites by a failure signal from outside, the heat generating part generates heat, and by this heat the holding part immediately releases holding of the conducting part. As a result, the conducting part is rotated by the rotating force of the elastic member, and the conduction between the first connection terminal and second connection terminal is cut off. As the electric connection between the first connection terminal and second connection terminal is cut off, the circuit is securely cut off in a short time, so that the electric parts can be protected.

Herein, the holding part contains a resin part, preferably, and the resin part is melted as the igniting part ignites depending on the cut-off signal and the heat generating part generates heat, so that holding of the conductive part is released quickly.

More preferably, the conducting part, heat generating part and igniting part are integrally contained in an outer container, and therefore the constitution is simple and the operation is secure.

Specifically, the holding part has a first rotation stopping part formed in the heating part, and a second rotation stopping part engaged with the first rotation stopping part and formed on the outer container, and at least one rotating stopping part of the first rotation stopping part and second rotation stopping part has a resin part.

More specifically, the elastic member is a coil spring, and one end of the coil spring is fixed to the igniting part, while the other end of the coil spring is fixed to the outer container.

The conducting part is a protrusion having a longitudinal part, and the longitudinal part connects between the first connection terminal and second connection terminal, so that the conductive state between the first connection terminal and second connection terminal is maintained, and when the longitudinal part is rotated by the rotating force of the elastic member and does not connect between the first connection terminal and second connection terminal, the conductive state between the first connection terminal and second connection terminal is cut off, which is also preferable for simple constitution and secure action.

Herein, the longitudinal part is preferred to be rotated by about 90 degrees by the rotating force of the elastic member, so that the circuit may be cut off securely.

On the other hand, a side wall is formed at the end of the heat generating part, and the end of the first connection terminal and the side wall, and the end of the second connection terminal and the side wall may be individually joined with low melting point materials.

In such constitution, usually, the conduction between the first connection terminal and second connection terminal is improved by the low melting point material, and in case of abnormality, the low melting point material is melted securely by the heat generation of the heating agent, and the electric connection between the first connection terminal and second connection terminal is cut off by the rotating force of the elastic material. Usually, meanwhile, since rotating force is not applied to the low melting point material, the reliability of junction between the first connection terminal and second connection terminal is enhanced.

The low melting point material is preferred to be one selected from the group consisting of Sn, Pb, Zn, Al and Cu.

The heat generating part contains the heating agent, and the heating agent is preferred to contain a thermite compound mixing powder of metal oxide and powder of aluminum because the thermite reaction heat can be securely generated by the thermite reaction.

In other words, the heat generating part contains the heating agent, and the heating agent contains at least one metal powder selected from the group consisting of B, Sn, Fe, Si, Zr, Ti and Al, and at least one metal oxide selected from the group consisting of CuO, $MnO_2$, $Pb_3O_4$, $PbO_2$, $Fe_3O_4$, $Fe_2O_3$ and $Cr_2O_3$.

Further, the heating agent may also contain additives having alumina, bentonite or talc.

DETAILED DESCRIPTION OF THE PREFERRED EMBODIMENT

Figure 1:
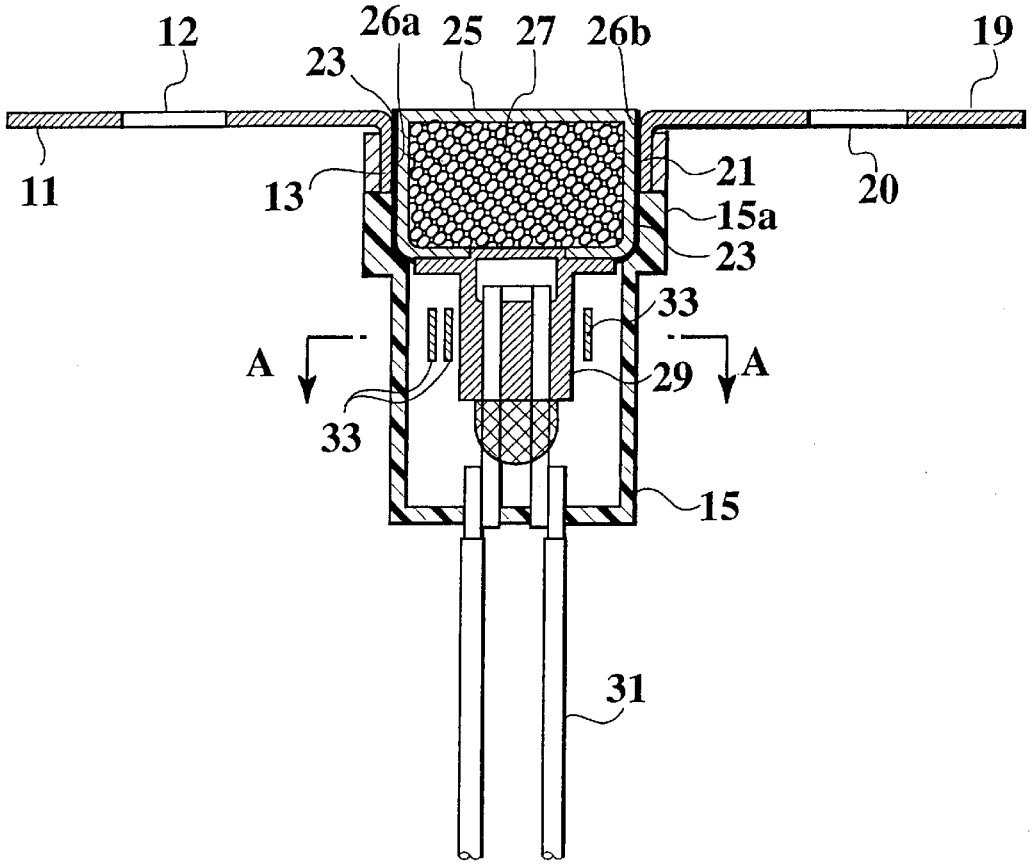
FIG. 1 is a sectional view before cut-off of a circuit breaker in an embodiment of the invention.

Referring now to the drawings, a preferred embodiment of the invention is described in detail below.

In the circuit breaker shown in FIG. 1, a first bus bar 11 of a long plate form is made of copper or copper alloy, and a round hole 12 to be connected to a battery or the like is formed in this first bus bar 11. A leading end 13 of the first bus bar 11 is bent downward nearly at right angle.

A second bus bar 19 of a long plate form is also made of copper or copper alloy, and a round hole 20 to be connected to a load or the like is formed in this second bus bar 19. A leading end 21 of the second bus bar 19 is also bent downward nearly at right angle.

Between the first bus bar 11 and second bus bar 19, a thermite case 25 is disposed as a heating unit filled with a heating agent 27, and a left side wall 26*a* of this termite case 25 is joined to the leading end 13 of the first bus bar 11 by means of a low melting point metal 23 as soldering material (melting point about 200 to 300 degrees). However of course, it is not limited to soldering material as far as the melting point is low and the connection strength is sufficient.

A right side wall 26*b* of the thermite case 25 is joined to the leading end 21 of the second bus bar 19 by means of low melting point metal 23. Accordingly, the first bus bar 11 and second bus bar 19 can be electrically connected with each other through the low melting point metal 23 and thermite case 25.

The thermite case 25 is preferably made of a material high in thermal conductivity and not melted by heat generation of the heating agent 27, for example, brass, copper, copper alloy, or stainless steel. The thermite case 25 is put in an outer case 15 as an outer container, and a case step 15*a* is formed in this outer case 15, and a thermite compartment 16 for accommodating the thermite case 25 is formed in this case step 15*a*. The outer case 15 is a container made of insulating material, and a thermoplastic resin may be preferably used.

Figure 2:
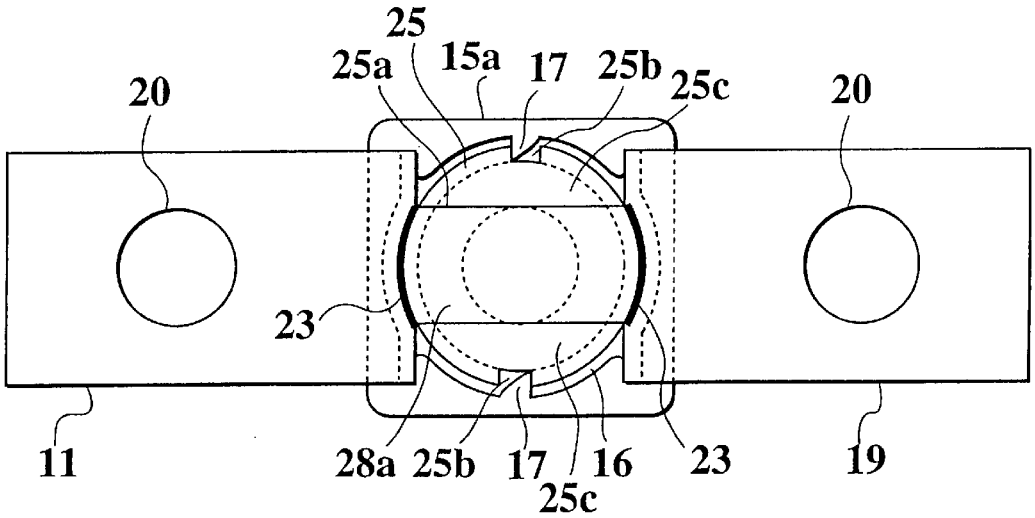
FIG. 2 is a top view before cut-off of the circuit breaker.
Figure 3:
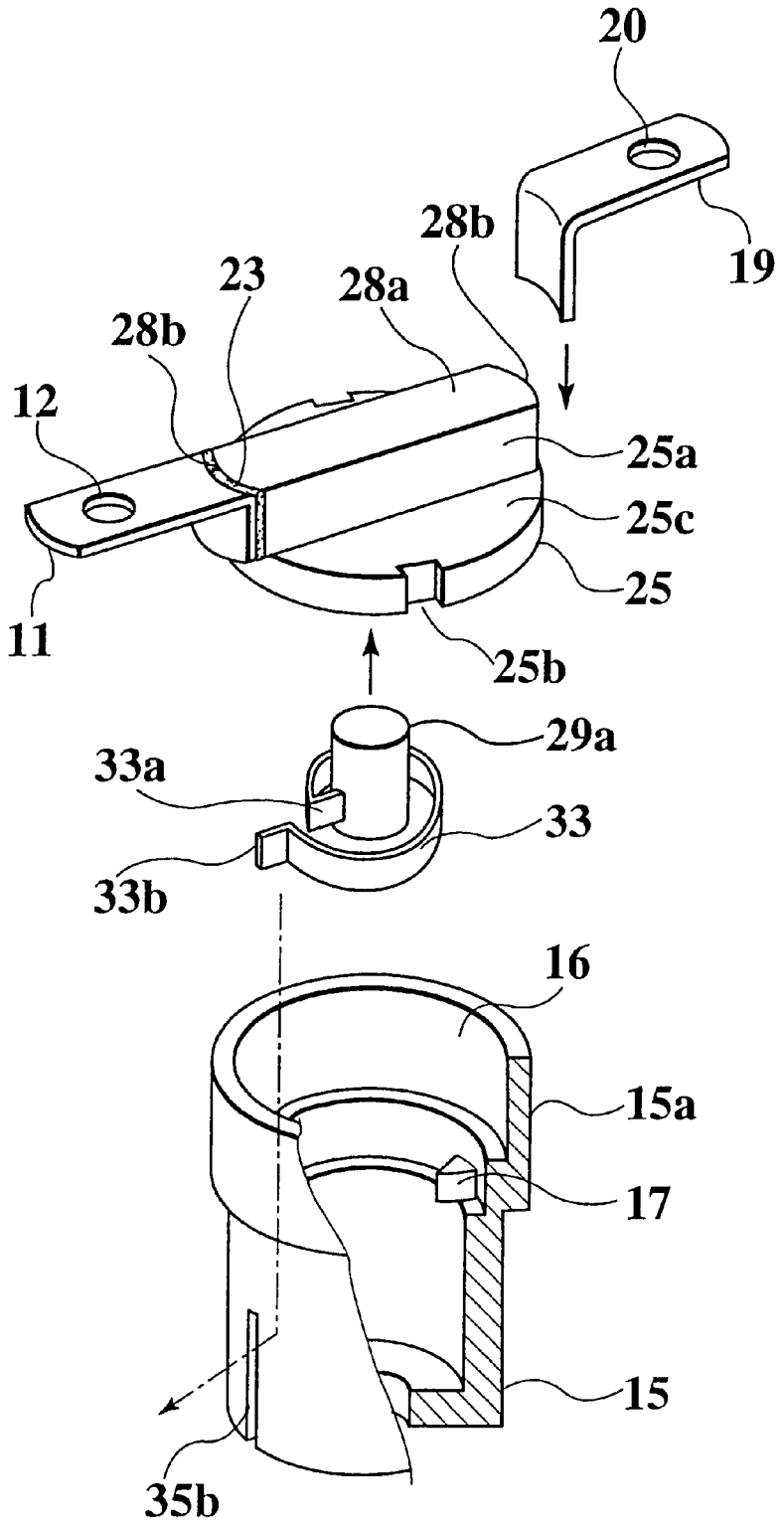
FIG. 3 is a diagram showing the rotation locking part and its surrounding structure of the circuit breaker.

The thermite case 25 has a thermite protrusion 25*a* as a conducting part with a protruding upper side as shown in FIG. 2 and FIG. 3, and this thermite protrusion 25*a* is a cylindrical form cut off at a specific width, and is composed of a linear longitudinal portion 28*a* and short arc portions 28*b* at its both ends.

The vertical position of the upper side of the thermite protrusion 25*a* is nearly same as the vertical position of the first bus bar 11 and second bus bar 19, and the vertical length of the thermite protrusion 29*a* is longer than the bus bar leading ends 13, 21, so that the upper surface 25*c* of the thermite case 25 may not contact with the bus bar leading ends 13, 21.

Near the outer circumference of the thermite case 25, two thermite grooves 25*b* are formed at positions different by about 180 degrees from each other as first concave rotation stopping parts, and rotation blocking parts 17 are formed in the case step 15*a* as second triangular rotation stopping parts to be respectively engaged with the thermite grooves 25*b*. The rotation blocking parts 17 stop rotation of the thermite case 25 having the thermite protrusion 25*a* and an igniting part 29 in the outer case 15.

Alternatively, the rotation blocking part 17 maybe formed as a groove, and the protrusion to be engaged with this groove may be formed in the thermite case 25, so that the rotation may be stopped in the thermite case 25 and the outer case 15 of the igniting part 29 described below. This protrusion may be formed integrally with the thermite case 25, or may be formed as a separate part made of resin.

In the lower part of the thermite case 25, there is the igniting part 29 containing an igniting agent case 29*a*. The igniting agent case 29*a* is coupled with the thermite case 25 by crimping with screw. They may be also coupled by crimping and welding, or by welding alone. The igniting part 29 is contained in the outer case 15, and has the igniting agent, and the igniting agent is ignited by heat generation caused by the current flowing in a lead wire 31 in case of abnormality of vehicle such as vehicle collision accident, and a thermite reaction heat is generated in the heating agent 27.

Figure 4:
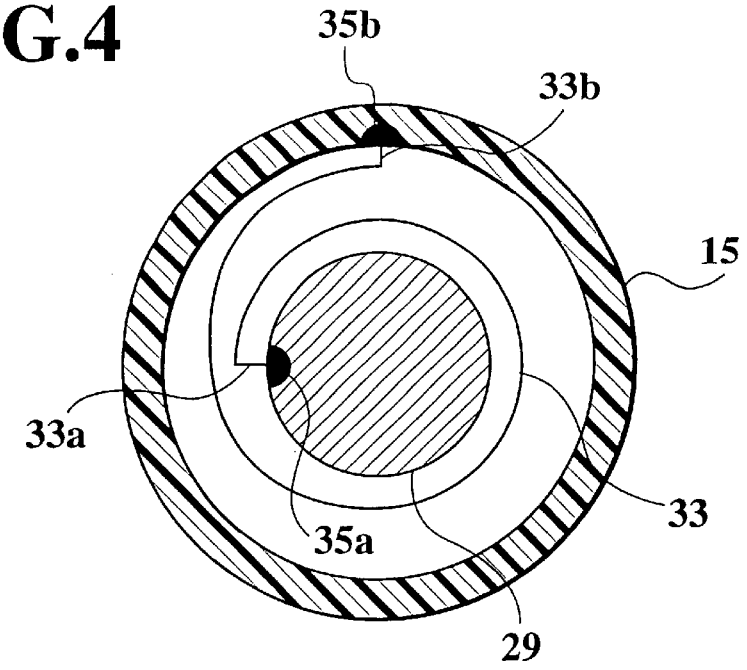
FIG. 4 is a sectional view of A—A of FIG. 1.

The igniting part 29 and the outer case 15 are linked with a coil spring 33 as a spiral elastic member free to expand and contract as shown in FIG. 3 and FIG. 4.

In the state before circuit cut-off as shown in FIG. 4, with the coil spring 33 compressed, a winding start portion 33*a* of the coil spring 33 is fixed to a winding start fixing portion 35*a* of the igniting part 29, and a winding end portion 33*b* of the coil spring 33 is fixed to a winding end fixing portion 35*b* of the outer case 15. The winding end fixing portion 35*b* is a long groove formed in the outer case 15, and the winding end portion 33*b* of the coil spring 33 is inserted in this long groove.

Since the coil spring 33 is in compressed state, it has a rotating force in the clockwise direction in FIG. 4. In order to stop rotation of the igniting part 29 and thermite case 25 by the rotating force of the coil spring 33, the rotating blocking part 17 is provided.

Figure 5:
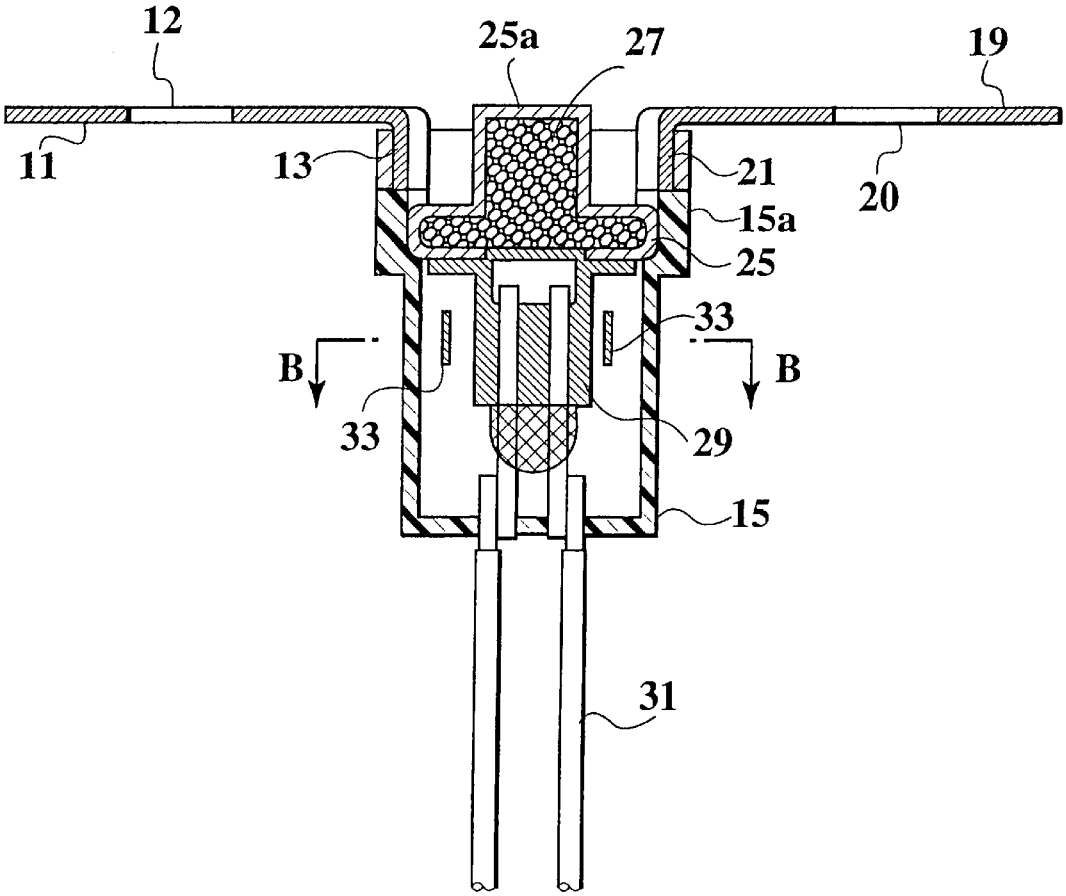
FIG. 5 is a sectional view after cut-off of the circuit breaker in the embodiment of the invention.
Figure 6:
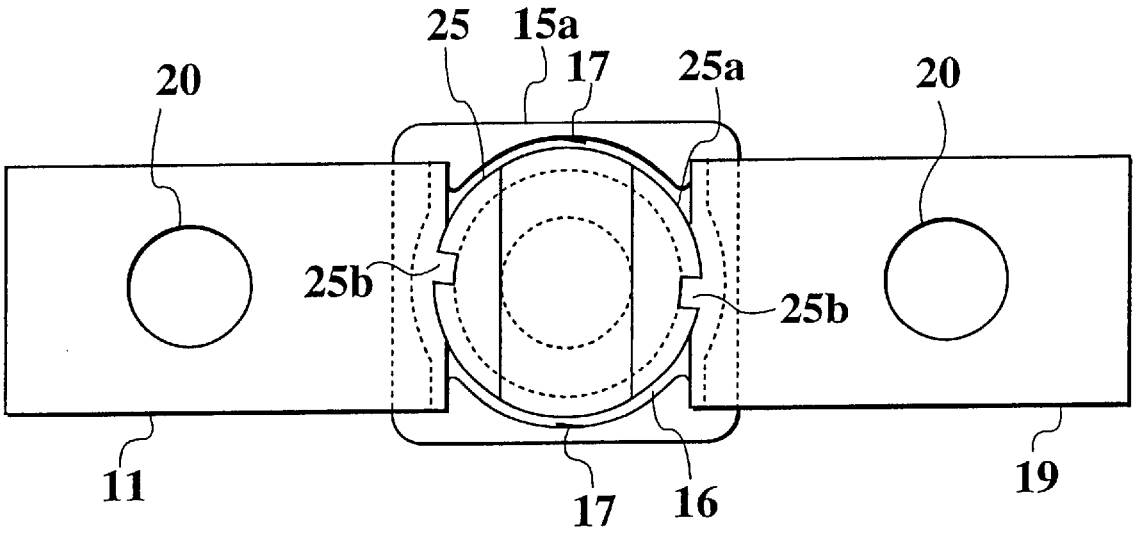
FIG. 6 is a top view after cut-off of the circuit breaker.
Figure 7:
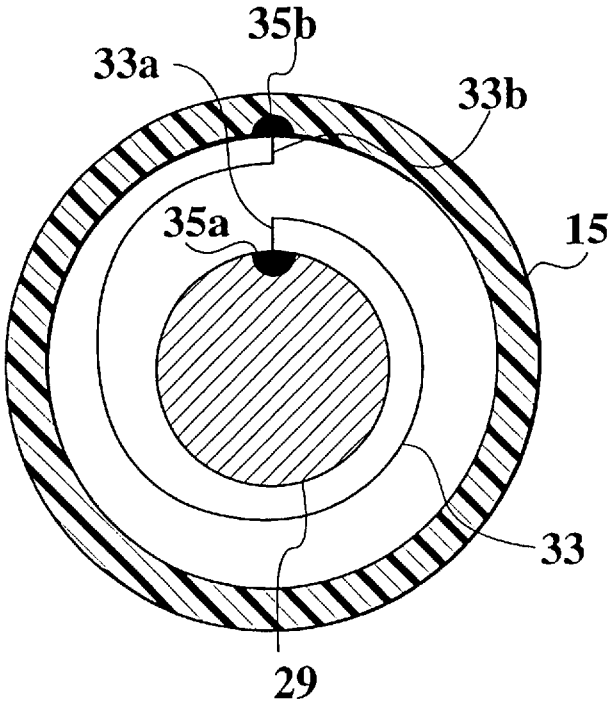
FIG. 7 is a sectional view of B—B of FIG. 5.
Figure 8:
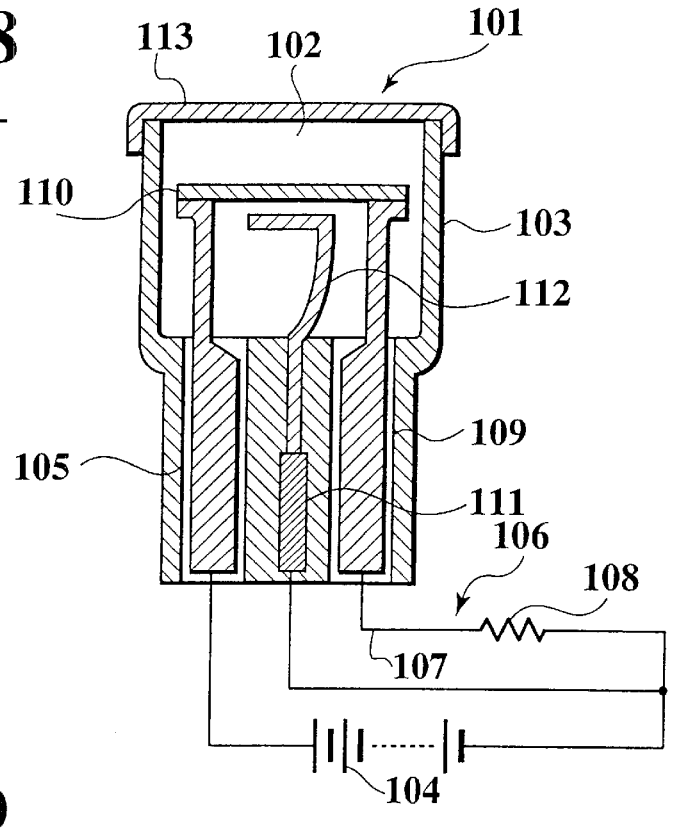
FIG.8 PRIOR ART
FIG. 8 is a sectional view showing an example of protective device using bimetal.
Figure 9:
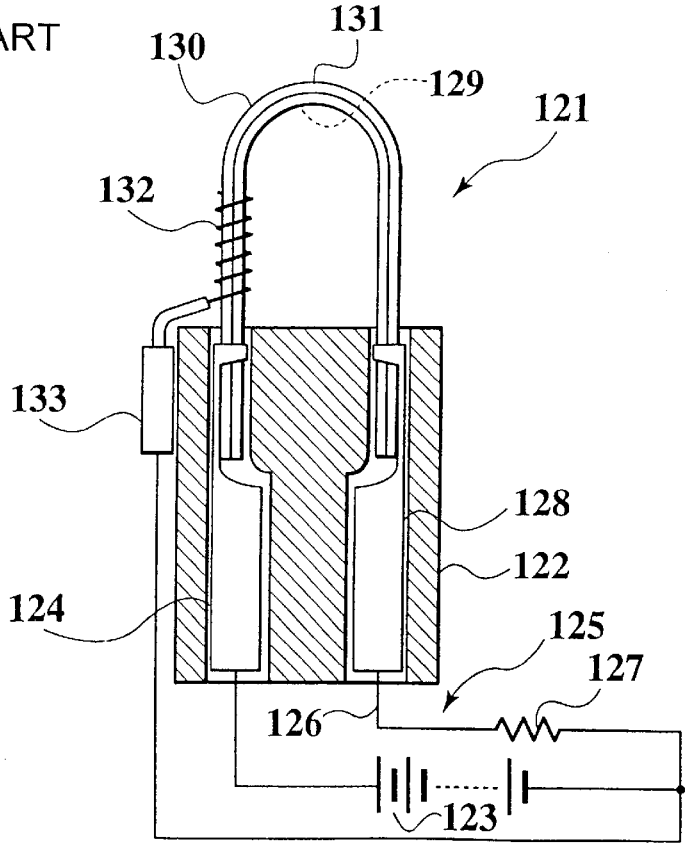
FIG.9 PRIOR ART
FIG. 9 is a sectional view showing other example of protective device.

In the state after cut-off of the circuit, as shown in FIG. 7, the coil spring 33 is rewound about 90 degrees in the clockwise direction, and by rewinding of the coil spring 33, as shown in FIGS. 5 and 6, the thermite case 25 and the igniting part 29 rotate about 90 degrees in the clockwise direction.

As the low melting point metal 23, at least one metal selected from the group consisting of Sn, Pb, An, Al and Cu is preferably used.

The heating agent 27 is a thermite compound composed of powder of metal oxide such as iron oxide ($Fe_2O_3$) and powder of aluminum, which generates high heat by inducting thermite reaction by heat generation of the led wire 31. As the metal oxide, instead of iron oxide ($Fe_2O_3$), chromium oxide ($Cr_2O_3$) or manganese oxide ($MnO_2$) may be used.

The heating agent 27 may be also a mixture composed of at least one metal powder selected from the group consisting of B, Sn, Fe, Si, Zr, Ti and Al, at least one metal oxide selected from the group consisting of CuO, $MnO_2$, $Pb_3O_4$, $PbO_2$, $Fe_2O_4$ and $Fe_2O_3$, and at least one additive selected from the group consisting of alumina, bentonite and talc. By using such heating agent, it is easily ignited by the igniting part 29, and the low melting point metal 23 can be melted in a short time.

In thus constituted circuit breaker of the embodiment, the operation is described below.

Usually, as shown in FIG. 4, the coil spring 33 is in compressed state, and in this compressed state, as shown in FIG. 2, the short portions 28*b* formed in the thermite protrusion 25*a* are electrically connected with the first bus bar 11 and second bus bar 19 through the low melting point metal 23, and therefore, the current is supplied from the battery to the load (neither shown).

If the vehicle collides against an obstacle or tumbles off a cliff or the like, the abnormality of the vehicle is detected by a collision sensor or the like. By detection of such abnormality of vehicle, a current flows into the igniting part 29 through the lead wire 31.

As a result, by heat generation by the current, the igniting part 29 ignites, and the heating agent 27 which is the thermite compound generates thermite reaction heat in the following reaction formula.

$$Fe_2O_3+2Al \rightarrow Al_2O_3+2Fe+386.2(kcal)$$

By this thermite reaction heat, the thermite case 25 is heated, and by the heat generation of the heating agent 27 and the heat of the thermite case 25, the low melting point metal 23 joining the bus bar leading end 13 and the left side wall 26*a* of the thermite case 25, and the low melting point metal 23 joining the bus bar leading end 21 and the right side wall 26*b* of the thermite case 25 are heated and melted. At the same time, the rotation blocking part 17 formed in the case step 15*a* of the outer case 15 is melted by heat.

Consequently, the coil spring 33 is rewound about 90 degrees in the counterclockwise direction as shown in FIG. 7, and by this rewinding, as shown in FIG. 5 and FIG. 6, the thermite case 25 and igniting part 29 rotate about 90 degrees in the counterclockwise direction.

That is, since the thermite protrusion 25*a* also rotates about 90 degrees in the counterclockwise direction, the short portions 28*b* no longer contact with the first bus bar 11 and second bus bar 19. As a result, the electric connection between the thermite case 25 and the first bus bar 11 and second bus bar 19 is cut off. That is, the first bus bar 11 and second bus bar 19 are electrically cut off, and the electric circuit of the vehicle is cut off.

Thus, according to the circuit breaker of the embodiment, the electric circuit of the vehicle can be cut off securely in a short time, and the electric parts can be protected. Moreover, by using the thermite reaction heat of the heating agent 27, the circuit breaker in a simple structure can be presented.

Moreover, since the rotation blocking part 17 arrests the rotating force of the coil spring 33, spring force of the coil spring 33 is not applied to the low melting point metal 23 at the junction of the first bus bar 11 and second bus bar 19 and the thermite case 25, so that the reliability of the junction may be enhanced.

Still more, using the coil spring 33, as compared with the compression spring expanding and contracting in the height direction (vertical direction), the size in the height direction can be reduced, so that the circuit breaker can be reduced in size.

The invention is not limited to the illustrated embodiment alone. In this embodiment, comprising the coil spring 33, rotation blocking part 17 and low melting point metal 23, the circuit is cut off when the rotation blocking part 17 and low melting point metal 23 are melted, but, for example, without using the low melting point metal 23, only the rotating blocking part 17 may be provided, and the circuit may be cut off when the rotating block part 17 is melted.

In the embodiment, the thermite groove 25*b* is concave, and the rotating blocking part 17 is convex, but, for example, a trapezoidal or semicircular thermite groove or rotating blocking part may be used. As far as the structure is designed to stop rotation of the thermite case 25, the shape of the thermite groove and rotating blocking part is arbitrary.

Also in the embodiment, the coil spring 33 is applied on the outer case 15 and igniting part 29, but the coil spring 33 may be applied on the outer case 15 and the thermite case 25.

Or, in the embodiment, as the coil spring 33, a spring having a rotating force when compressed is used, but a spring having a rotating force when expanded may be also used as the coil spring. In this case, when the coil spring is in expanded state, the thermite protrusion 25*a* is as shown in FIG. 1, and after rotation of the coil spring, the thermite protrusion 25*a* is as shown in FIG. 4. Besides, the invention may be further changed and modified in various forms within the technical scope thereof.

What is claimed is:

1. A circuit breaker comprising:

a first connection terminal;

a second connection terminal;

a rotatable conducting part disposed between said first connection terminal and second connection terminal;

a heat generating part;

an igniting part igniting depending on a cut-off signal;

an elastic member capable of producing a rotating force and free to expand and contract; and a holding part holding said conducting part while resisting said rotating force of said elastic member, wherein when said holding part perform holding of said conducting part, a conductive state between said first connection terminal and second connection terminal is maintained, and when said holding part releases said holding of said conducting part as said igniting part ignites depending on said cut-off signal and said heat generating part generates heat, said conducting part is rotated by said rotating force of said elastic member, and said conductive state between said first connection terminal and second connection terminal is cut off.

2. A circuit breaker according to claim 1, wherein said holding part contains a resin part, and said resin part is melted as said igniting part ignites depending on said cut-off signal and said heat generating part generates said heat.

3. A circuit breaker according to claim 2, wherein said conducting part, said heat generating part and said igniting part are integrally contained in an outer container.

4. A circuit breaker according to claim 3, wherein said holding part has a first rotation stopping part formed in said heating part, and a second rotation stopping part engaged with said first rotation stopping part and formed on said outer container, and at least one of said first rotation stopping part and said second rotation stopping part has said resin part.

5. A circuit breaker according to claim 3, wherein said elastic member is a coil spring, and one end of said coil spring is fixed to said igniting part, while the other end of said coil spring is fixed to said outer container.

6. A circuit breaker according to claim 1, wherein said conducting part is a protrusion having a longitudinal part, and said longitudinal part connects between said first connection terminal and said second connection terminal, so that said conductive state between said first connection terminal and said second connection terminal is maintained, and when said longitudinal part is rotated by said rotating force of said elastic member and does not connect between said first connection terminal and said second connection terminal, said conductive state between said first connection terminal and said second connection terminal is cut off.

7. A circuit breaker according to claim 6, wherein said longitudinal part is substantially rotated by 90 degrees by said rotating force of said elastic member.

8. A circuit breaker according to claim 1, wherein a side wall is formed at an end of said heat generating part, and an end of said first connection terminal and said side wall, and an end of said second connection terminal and said side wall are individually joined with a low melting point material.

9. A circuit breaker according to claim 8, wherein said low melting point material is at least one selected from the group consisting of Sn, Pb, Zn, Al and Cu.

10. A circuit breaker according to claim 1, wherein said heat generating part contains a heating agent, and said heating agent contains a thermite compound mixing powder of metal oxide and powder of aluminum.

11. A circuit breaker according to claim 1, wherein said heat generating part contains a heating agent, said heating agent contains at least one metal powder selected from the group consisting of B, Sn, Fe, Si, Zr, Ti and Al, and at least one metal oxide selected from the group consisting of CuO, $MnO_2$, $Pb_3O_4$, $PbO_2$, $Fe_3O_4$, $Fe_2O_3$ and $Cr_2O_3$.

12. A circuit breaker according to claim 11, wherein said heating agent further contains an additive containing alumina, bentonite or talc.

* * * * *

UNITED STATES PATENT AND TRADEMARK OFFICE

CERTIFICATE OF CORRECTION

PATENT NO. : 6,275,136 B1
DATED : August 14, 2001
INVENTOR(S) : Noboru Yamaguchi It is certified that error appears in the above-identified patent and that said Letters Patent is hereby corrected as shown below:

Title page,
Item [57], ABSTRACT, line 12, "conducing part" should read -- conducting part --.

Column 8, claim 1,
Line 51, "holding part perform" should read -- holding part performs --.

Signed and Sealed this

Twelfth Day of March, 2002

*Attest:*

*Attesting Officer*

JAMES E. ROGAN
*Director of the United States Patent and Trademark Office*